US005085261A

United States Patent [19]

Bortoluzzi

[11] Patent Number: 5,085,261

[45] Date of Patent: Feb. 4, 1992

[54] LONGITUDINALLY SLIDING ACCORDION DOOR

[75] Inventor: Guido Bortoluzzi, Belluno, Italy

[73] Assignee: Molteni & C. S.p.A., Milan, Italy

[21] Appl. No.: 366,421

[22] Filed: Jun. 15, 1989

[30] Foreign Application Priority Data

Jun. 17, 1988 [IT] Italy ..... 45736 A/88

[51] Int. Cl.[5] ..... E05D 15/26

[52] U.S. Cl. ..... 160/199; 160/206

[58] Field of Search ..... 160/199, 206, 196.1; 16/97, 99, 105, 100

[56] References Cited

U.S. PATENT DOCUMENTS

| | | | |
|---|---|---|---|
| 1,499,312 | 6/1924 | Ferris | 160/199 |
| 2,959,220 | 11/1960 | Latham | 160/199 |
| 3,116,782 | 1/1964 | Rudnick | 160/206 X |
| 3,335,784 | 8/1967 | Risk et al. | 160/199 |
| 3,536,120 | 10/1970 | Kellems . | |
| 3,554,267 | 1/1971 | Brinker | 160/206 X |
| 4,726,637 | 2/1988 | Ishizawa et al. | 160/199 X |

FOREIGN PATENT DOCUMENTS

| | | |
|---|---|---|
| 0200542 | 11/1986 | European Pat. Off. . |
| 1491843 | 11/1977 | United Kingdom . |

*Primary Examiner*—Blair M. Johnson
*Attorney, Agent, or Firm*—Wenderoth, Lind & Ponack

[57] ABSTRACT

An accordion door includes two half-wings hinged along innermost vertically extending sides thereof, and pivotally supported at upper and lower ends of the outermost vertically extending sides of the door by arms which project from respective trucks slidably engaged with respective upper and lower guide members. The trucks also include three pairs of wheels disposed on three axes orthogonal to each other. The wheels of each pair are fairly spaced apart and engage parallel and opposite surface of longitudinal elements making up the guide members. The trucks are thus confined to slide freely along only a horizontal axis defined by the guide members and cannot deviate from such an axis or from horizontal and vertical axes orthogonal thereto. The accordion door is supported at its lower part on arms of lower ones of the trucks and is suspended from arms of upper ones of the trucks which are quite elastic and are provided with an adjustment device that allows that part of the weight of the door loading the upper trucks to be adjusted. The trucks are also provided with spreading apart devices actuated by the same half-wings during the opening movement thereof, which spread apart the edges of the outermost sides of the accordion door from fixed surfaces which, at the closed position thereof, are adjacent thereto. Finally, the trucks include fixed spacer elements which space the trucks fairly far apart when the door is in the open position.

9 Claims, 7 Drawing Sheets

LONGITUDINALLY SLIDING ACCORDION DOOR

BACKGROUND OF THE INVENTION

The present invention relates to an accordion door, which can slide longitudinally and which can be fitted to furniture, particularly lockers, as well as to other various frames such as windows and the like.

As it is known, particularly in the field of furniture, e.g. for lockers and the like, so-called accordion doors are vertically divided into two half-wings identical to each other and hinged together at their central part. The central part thereof is shifted outwardly during the opening movement thereof, while the outermost sides of the two half-wings slide toward one another.

Normally, one of the two sides of the door is fixed and adequately pivoted in the piece of furniture, while the other side is slidingly supported thereon and appropriately guided by guide members fitted to the piece of furniture at the upper and lower parts of the door. Therefore, the two half-wings may be moved from a first position corresponding to the closed position of the door, in which they are disposed coplanar, to a second position corresponding to the opening position of the door in which the hinged central part thereof is shifted outwardly and the two half-wings confront one another, so as to expose the previously covered part of the piece of furniture.

Such doors are clearly limited in number in application to a piece of furniture, although it would be desirable and profitable to employ many doors which not only form a bellows structure but which are also able to translate longitudinally.

Several solutions for this problem have been attempted. However, such solutions result in doors which are all known to be complicated and quite unstable.

In fact, a considerable vertical instability of the single doors is always present when they are slid in their opened position and particularly in such doors having wings extending a remarkable amount in the vertical direction, such as the doors of lockers.

SUMMARY OF THE INVENTION

An object of the present invention is to obviate these drawbacks by providing simple and reliable single or multi-accordion doors which can translate longitudinally in a stable and safe manner along the front of the piece of furniture, and which can also have a considerable vertical dimension such as the doors of lockers and the like. The accordion doors are formed in a per se known way by two half-wings hinged along respective vertically extending sides thereof, so as to be movable from a closed position in which said half-wings are coplanar at the front of the piece of furniture to an opened position in which the half-wings are folded along the hinged axis thereof while being arranged fairly spread apart. The invention is characterized in that said half-wings are pivotally supported at upper and lower ends of the outermost sides thereof to arms which project from respective support elements slidably engaged with upper and lower guide members fitted to the front of the piece of furniture. The support elements are trucks each provided with three groups of two wheels, disposed on three axes orthogonal to each other. The wheels of each group are fairly spaced apart from one another and engage parallel and opposite surfaces of respective longitudinal elements constituting a longitudinal guide member. Such an arrangement permits the trucks to slide freely along a horizontal axis defined by the respective longitudinal guide member while preventing the trucks from deviating from the horizontal axis as well as from horizontal and vertical axes orthogonal thereto. The accordion door is also supported at its lower part on respective lower arms extending from lower trucks and connected thereto by elements providing a hinged connection. The upper part of the door, on the contrary, is suspended from upper arms projecting from the upper trucks, such upper arms additionally being fairly elastic and provided with adjusting means for allowing that part of the weight of the door exerting a load on the upper trucks to be varied. The support elements are also provided with spreading apart devices which are actuated by the half-wings during the opening thereof to spread apart the edges of said outer vertical sides of the accordion door from fixed surfaces which, at the closed position of the door, are adjacent thereto. The support elements further include fixed spacer elements which position the half-wings fairly spaced apart from one another when the half-wings are disposed in their opened position.

BRIEF DESCRIPTION OF THE DRAWINGS

The invention will be described in more detail hereinafter, by way of a non-limitative example thereof, with reference to the attached drawings in which.

Figures 1, 2:
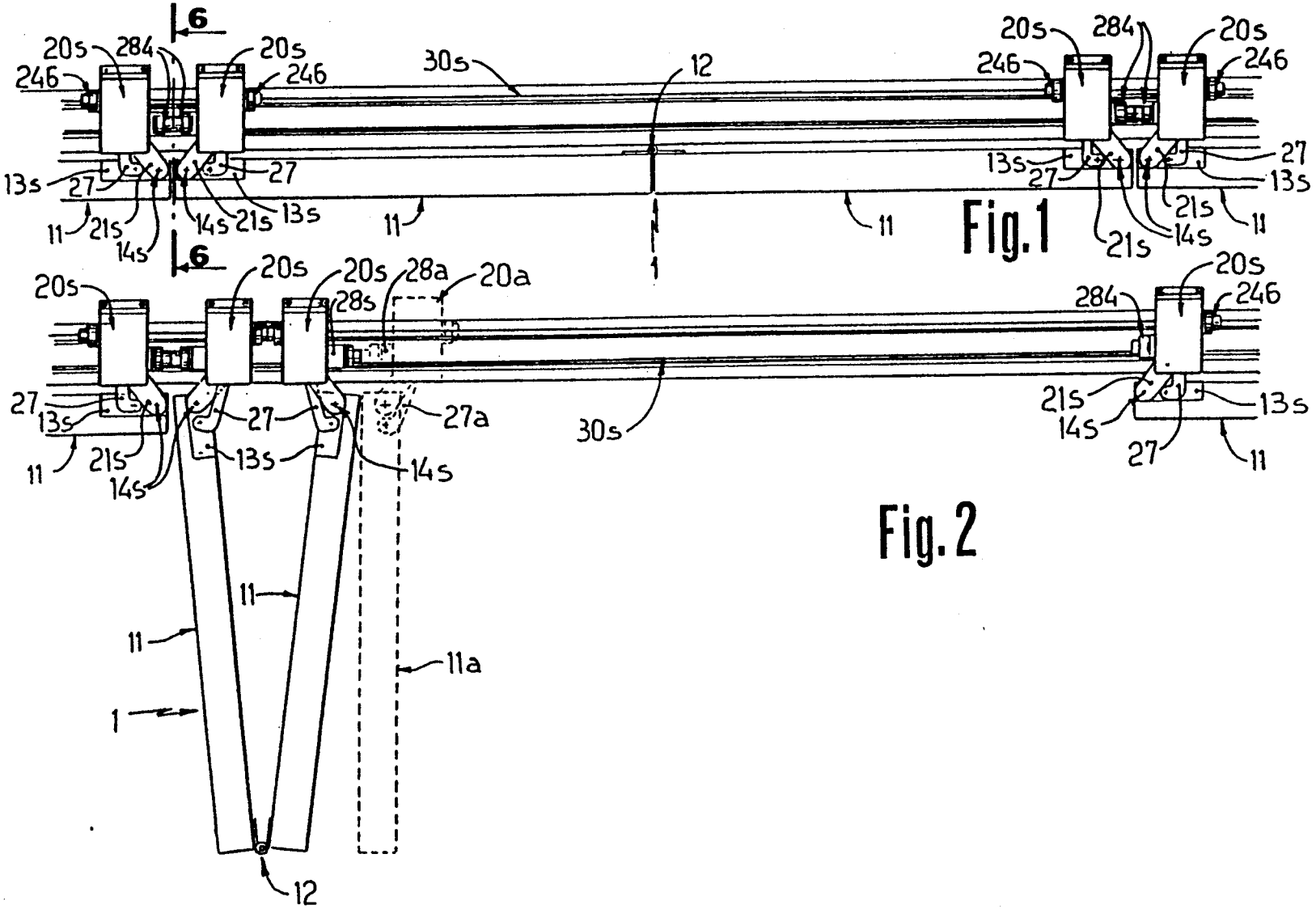
FIG. 1 is a plan view of an accordion door disposed in the closed position between two doors of the same kind, according to the present invention.
FIG. 2 is a view similar to FIG. 1, but showing the door in the opened position.

In such figures, common elements are marked with the same reference numerals. And, elements which have completely or partially identical structure but which differ by only being disposed opposite one another at the lower or upper part of the door, are marked with the same reference numerals followed, respectively, by the delineating letter "i" or "s".

DETAILED DESCRIPTION OF THE PREFERRED EMBODIMENTS

With reference to the figures, and particularly to FIGS. 1 and 2, accordion door 1 is formed by two half-wings 11 pivotally connected with a hinge 12 extending vertically along respective first sides thereof at an internal part of the door.

Moreover, the two half-wings 11 are hinged at the outer ends thereof (upper and lower ends), adjacent their respective other sides, with the studs 14*i* and 14*s*. The studs 14*i*, 14*s* connect respective lower and upper brackets 13*i* and 13*s* to corresponding arms 21*i* and 21*s* of respective trucks 20*i* and 20*s*. The trucks 20*i*, 20*s* in turn engage respective lower and upper longitudinal guide members 30*i* and 30*s*. As clearly shown in FIGS. 6–13, said lower and upper longitudinal guide members 30*i* and 30*s* are identical and the lower and upper trucks 20*i* and 20*s* are identical, except for the parts thereof connected to the door, which parts will be described later in detail.

Further, as clearly shown in FIGS. 1, 2, 8, 9 and 11, the trucks fitted at the right side of the door are symmetrical to those fitted at the left side thereof.

More specifically, the longitudinal guide members 30 are constituted by a section (see FIGS. 3, 6 and 7) comprising a planar strip 31 and four flanges orthogonally extending therefrom. These flanges include two internal flanges 32 and two external flanges 33, adequately spaced from each other. The two external flanges 33 extend from the sides of said planar strip 31. Each external flange 32 terminates with a further flange 34, facing the two internal flanges 32 and extending parallel to said planar strip 31. Each truck 20 is so shaped as to form an element that is able to slide only along the horizontal x-axis, which axis is defined by a respective longitudinal guide member 30, without being able to move at all along the horizontal and vertical axes y and z extending orthogonally to the horizontal x axis.

Figure 4:
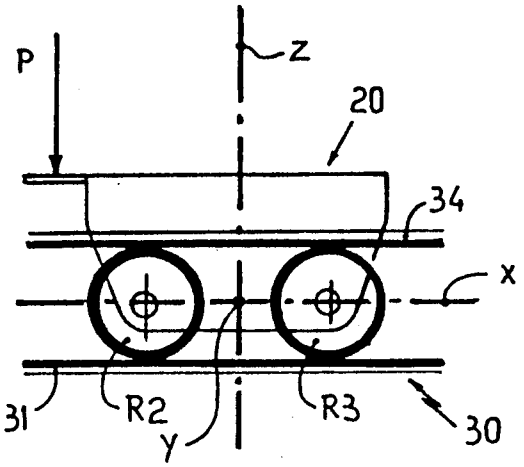
FIGS. 3, 4, and 5 are schematic diagrams of a truck in slidable engagement with a respective guide member, according to the present invention.
Figure 3:
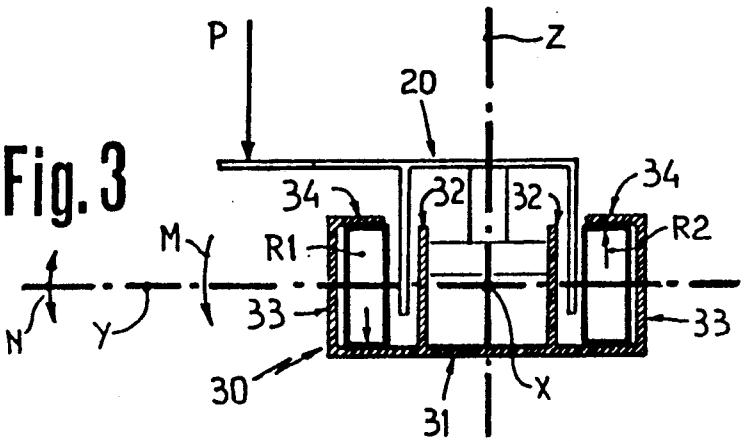
Figure 10:
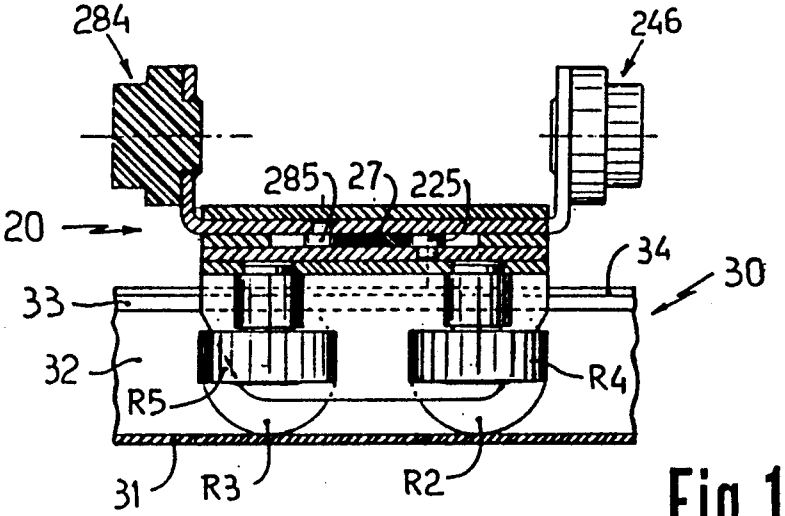
FIG. 10 is a sectional view taken along line 10—10 of FIG. 8.
Figure 5:
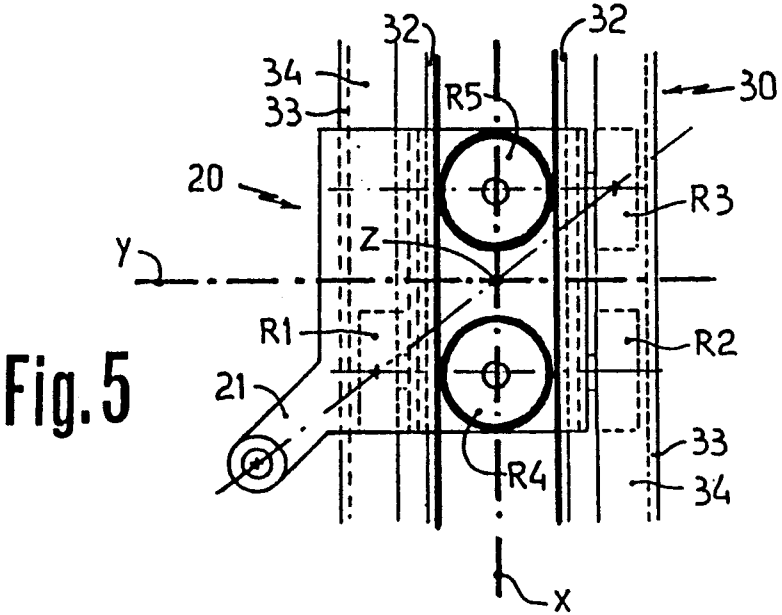
Figure 6:
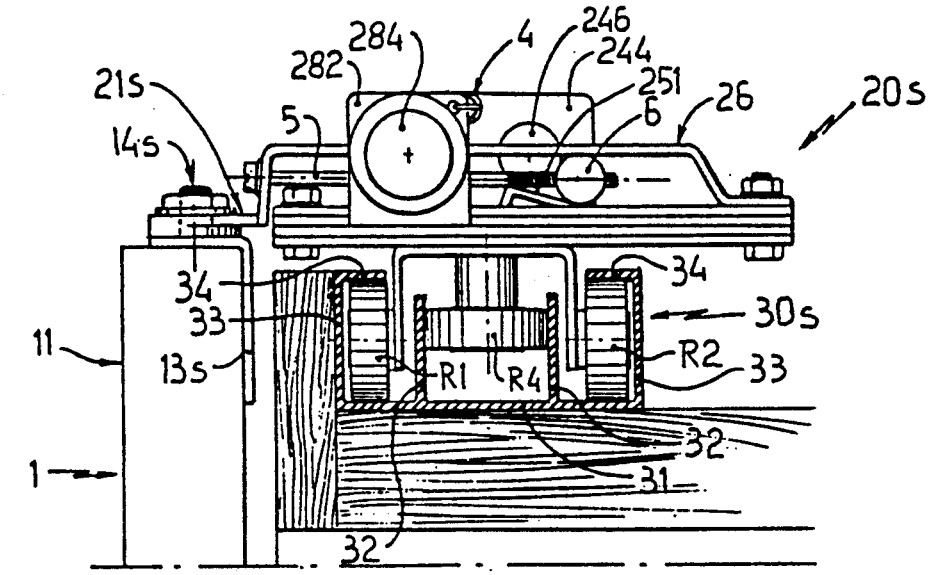
FIGS. 6 and 7 are sectional views taken along line 6—6 of FIG. 1, respectively, of upper and lower support units of the door.
Figure 7:
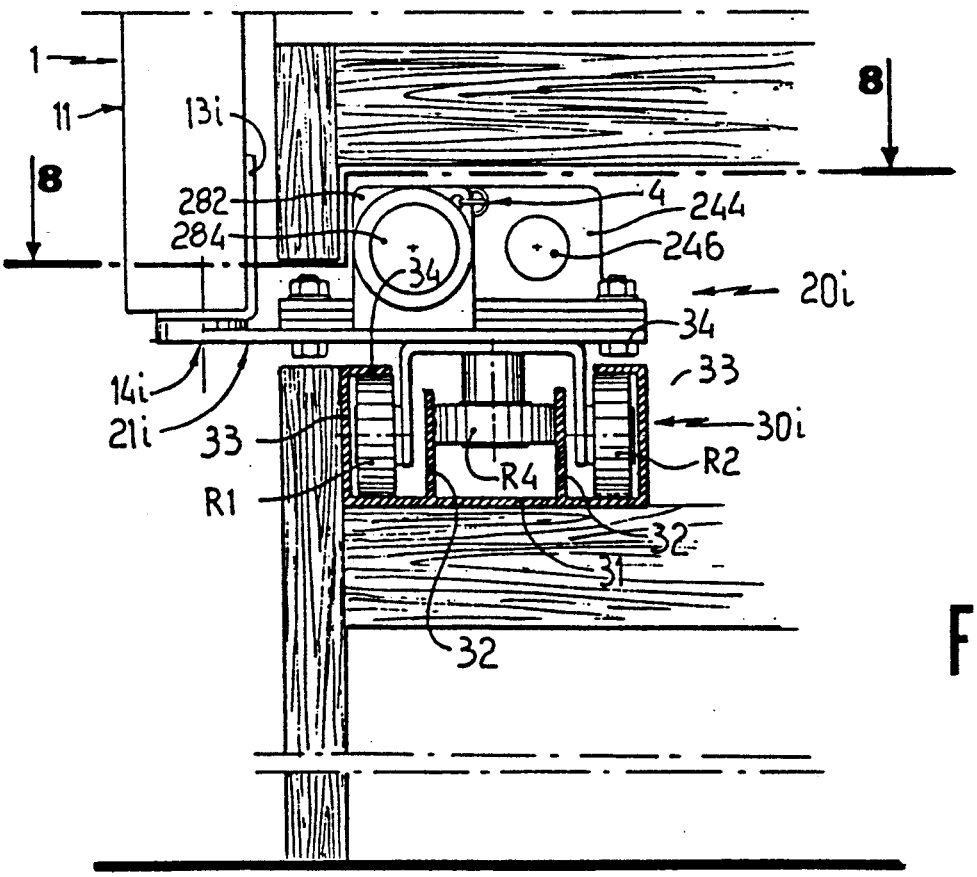

This is all clearly shown in FIGS. 3, 4 and 5, which schematically illustrate, in three sectional views taken orthogonally of one another, a truck 20 and an associated guide member 30.

In these figures the three orthogonal axes x, y, z are shown with dashed lines, while a pair of wheels and the associated guide surfaces, preventing the truck from deviating in its longitudinal movement with respect to said three axes x, y, z, are shown with heavy dark lines.

It is to be noted that such pairs of wheels are advantageously identical to each other.

Referring to FIG. 3, a first pair of coaxially spaced wheels R1 and R2 engage corresponding longitudinal grooves defined between the planar strip 31, external flanges 33 and terminal flanges 34.

Such wheels R1 and R2 each have a diameter practically identical to the distance between the opposite internal surfaces of said planar strip 31 and the flanges 34, so that any rotational movement of the truck 20 about said x axis is clearly prevented.

More particularly, the load P determined by the weight of the door and acting on the free end of the arm 21, tends to rotate the truck 20 around the axis x as indicated by the arrow M. Therefore, wheel R1 is pushed downwardly while the wheel R2 is pushed upwardly and bears respectively against the planar strip 31 and the flange 34, which clearly prevent the truck 20 from being rotated around such x axis. It is to be noted that a force exerted in an opposite direction would cause the impact of the wheel R1 against the corresponding flange 34 and the impact of the wheel R2 against the planar strip 31, so that it follows that the truck 20 is also prevented from rotating around the axis x in said opposite direction.

FIG. 3 clearly indicates the prevention of the rotation of the truck 20 in the two opposite directions represented by the arrows N on the y-axis.

On the other hand, referring to FIG. 4, a second pair of wheels R2 and R3 are spaced from each other and are aligned in the rear groove of the guide member 30, which is bounded at its upper part by the rear flange 34 and at its lower part by the planar strip 31. The wheels R2 and R3 bear against rear flange 34 and planar strip 31 thus preventing the truck 20 from rotating around the horizontal y-axis, which is transverse to the longitudinal guide member 30 and orthogonal to the horizontal x-axis.

Advantageously, one of the wheels of the second pair of wheels may be constituted by a wheel of the above-described pair of wheels R1, R2.

More precisely, in the illustrated embodiment, the wheel R2 is employed in common with respect to both pairs of wheels. Finally, referring to FIG. 5, the wheels of a third pair of wheels R4 and R5 fitted to the truck 20 are rotatably supported about vertical axes and are adequately spaced from each other as aligned along the horizontal x-axis defined by the guide member 30. The wheels engage a groove bounded by the inner surfaces of the internal flanges 32 of said guide member 30, wherein the distance between such walls is practically equal to the diameter of the wheels R4 and R5. The third pair of wheels R4 and R5, therefore, is guided by such internal flanges 32 which clearly prevent the truck 20 from rotating around the vertical axis z.

In summary, the longitudinal translation of the truck 20 is facilitated along the associated guide member 30 while, on the contrary, any deviation thereof with respect to the three orthogonal axes x, y and z is prevented.

Consequently, the projecting arm 21 of truck 20, at the end of which the door 1 is engaged as described later, acts as a cantilever which, particularly when said door 1 is fitted thereto with a hinged joint, inhibits moments from being exerted which could cause vertical stresses on the door.

Therefore, the application of four trucks of the described kind to an accordion door 1, and more precisely of two trucks at the sides of its upper end and of two trucks at the sides of its lower end, permits the door to freely translate in a very steady and reliable way along the front part of an associated piece of furniture. As already specified, the accordion door 1 is pivoted vertically at the sides of its lower and upper ends, i.e., at the ends of respective arms 21*i* and 21*s* extending from corresponding trucks 20*i*–20*s*.

If the door is pivotally supported in correspondence with or in front of the front surface thereof, when the door 1 is opened and the half-wings 11 thereof rotate around their pivotal axes, there is little concern that side edges of the door will touch and thus rub a wall or of the edge of a door adjacent thereto. On the contrary, if the door is pivotally supported behind the front surface thereof, the corners of the side edges of the door 1 while rotating around the pivotal axes thereof would intercept edges of elements adjacent thereto, so that it is necessary for these corners to be progressively moved away from the edges of adjacent elements during rotation of the half-wings 11.

This may be obtained by providing the upper and lower trucks 20*s* and 20*i*, having the arms 21 at which the two half-wings 11 are pivotally supported, with spacer elements 28 which, when actuated by the rotational movement of the half-wings as the accordion door 1 is shifted toward its opened position, are withdrawn from the trucks 20 by the half-wings while pushing the correspondent trucks 20 and therefore the correspondent pivotal axis thereof away from the trucks of an adjacent door. The trucks 20 using spacer elements 28 are clearly illustrated in FIGS. 12 and 13 a well as in FIGS. 6, 7, 8, 9, 10 and 11, which also illustrate the practical application thereof to an accordion door 1 as well as the operation thereof described in more detail below.

In the preferred embodiment to which reference is made, such trucks 20 comprise elements of sheet metal having an adequate thickness, which elements are simply sheared, bent and assembled together.

Figure 12:
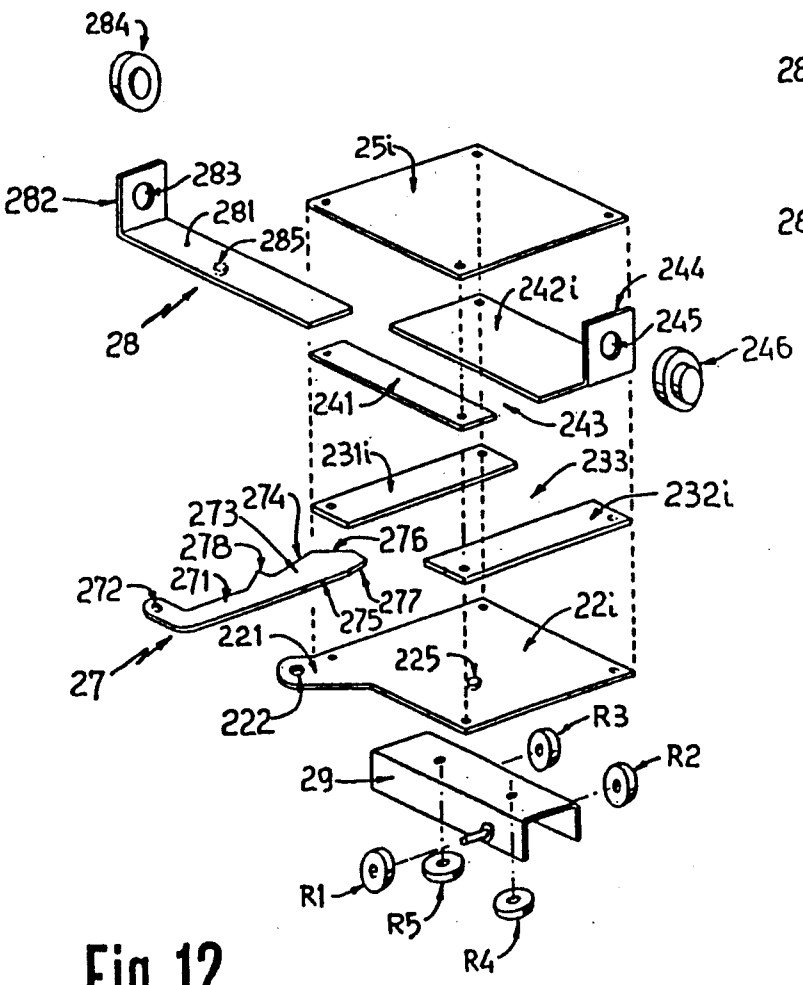

Referring particularly to FIG. 12, the structure of a lower truck 20*i* and, more precisely, of a truck which will be fitted to the left side of an accordion door 1 will be described. The truck to be fitted to the right side of the door is substantially identical thereto.

As is clearly seen from the figure, truck 20*i* is formed by a lower rectangular plate 22*i* at the left and front part of which a lug 221 projects. Lug 221 is provided at the center of its free end with a hole 222 in which the stud 14*i* of a half-wing 11 is engaged. Truck 20*i* also includes two rectangular plates 231 and 232 disposed over the plate 22*i* at the sides thereof, two additional rectangular plates comprising a front plate 241 and a rear plate 242*i* which are disposed orthogonally over the plates 231,232 at the front and rear of the thus resulting structure, respectively, and finally an upper rectangular plate 25*i* identical to the lower rectangular plate 22 with the exception of lug 221. This group of plates is assembled by means of adequate bolts, extending through respective holes defined at the four corners of the structure referred to.

The two plates 231–232 define a rectangular groove 233 between the underlying lower rectangular plate 22*i* and the overlying rectangular plates 241–242*i*, within which groove 223 a shaped plate 27 which will be hereinafter described in more detail is disposed and is able to be translated.

Also the rectangular plates 241–242 define a further rectangular groove 243, in which the movable spacer element 28 is disposed and is able to be shifted and guided. In addition, a lug 244 provided with a central hole 245 in which a rubber plug 246 is fitted, extends upwardly from and orthogonally to the front part of the right side of the rear plate 242*i*.

The movable spacer element 28 is formed by a rectangular tongue 281, bent at one end to form a short lug 282 directed orthogonally upwards. The lug 282 is identical to the lug 244 and is provided with a central hole 283 in which a correspondent rubber plug 284 identical to the plug 246 is fitted.

A return spring 4 (FIGS. 8, 9 and 11) is arranged between lug 282 and the lug 244. Moreover, from the lower surface of said tongue 281 extends a short pin 285 which cooperates, as described later, with a further pin 225 projecting from the upper surface of said lower rectangular plate 22*i*. At the lower part of plate 22*i* is fixed a "U"-shaped section having a front vertical flange on which the wheel R1 is pivotally supported, a rear vertical flange on which the wheels R2, R3 are pivotally supported, and a central flange on which wheels R4, R5 are pivotally supported, thus providing the already described truck 20.

Figure 8:
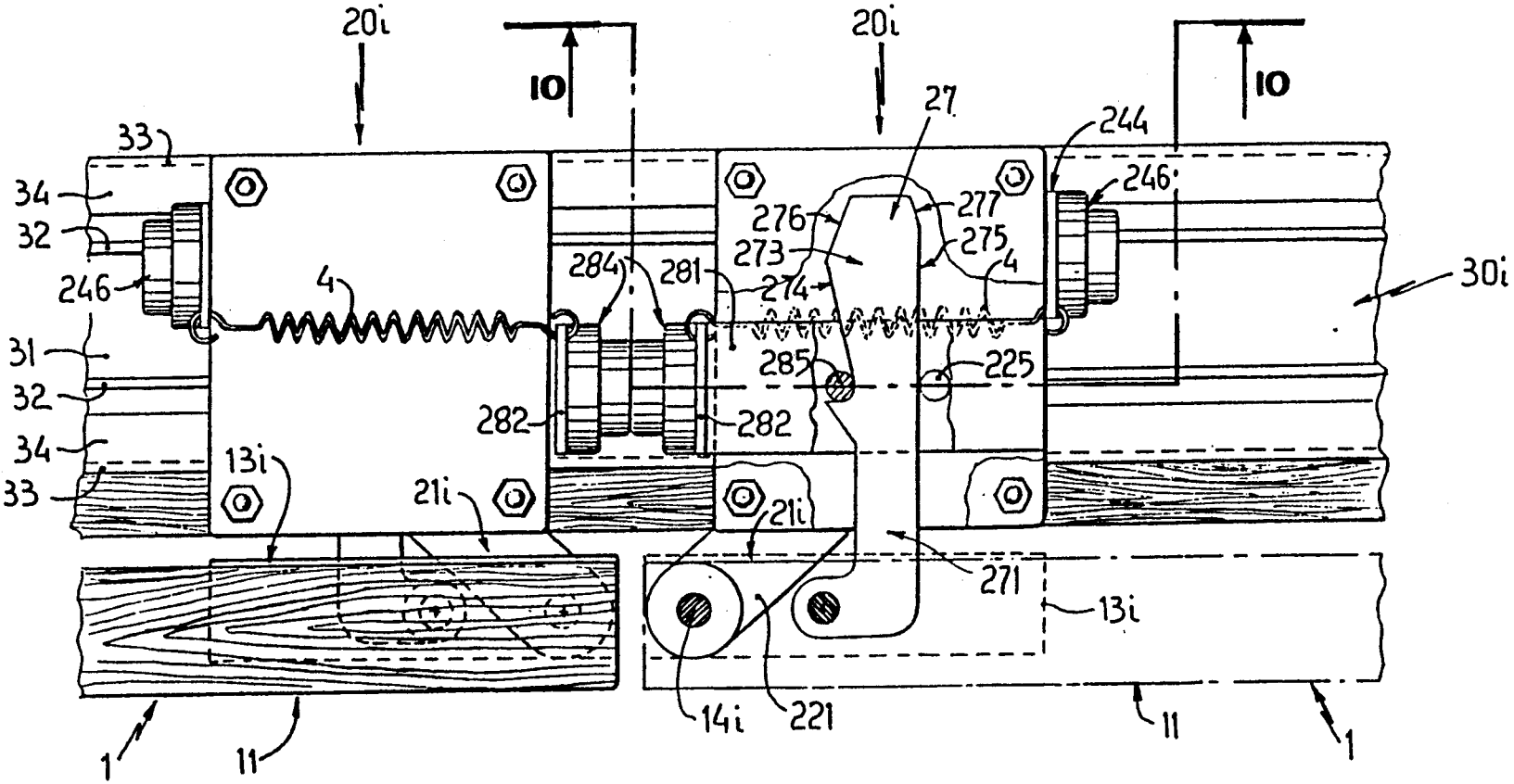
FIG. 8 is a sectional view, taken along line 8—8 of FIG. 7, of two lower support units of two doors which are disposed adjacent to each other in the closed position thereof.
Figure 11:
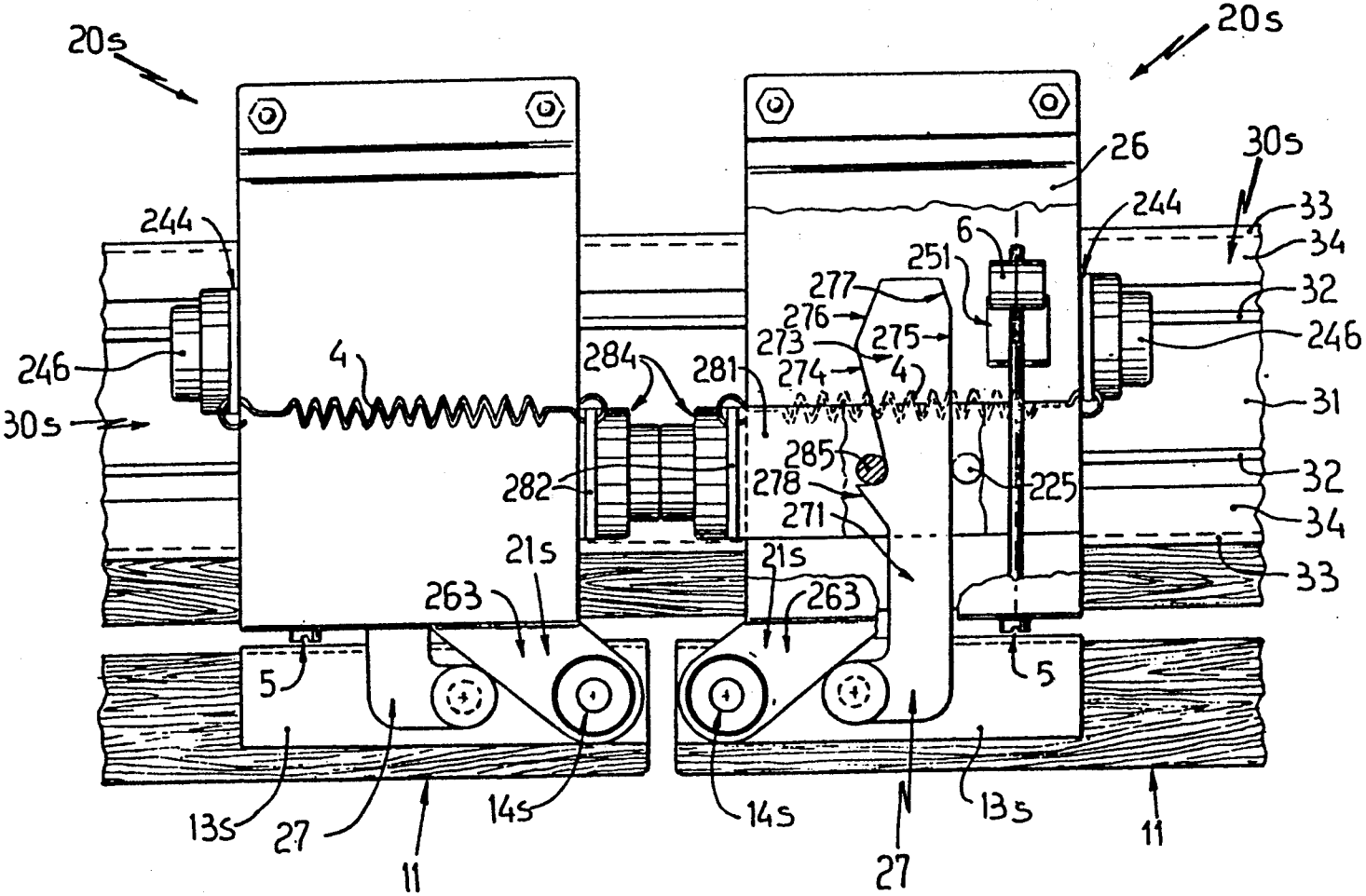
FIG. 11 is a plan view of the two upper support units illustrated in FIG. 8.

Finally, referring particularly to FIGS. 8 and 11, said shaped plate 27 has a first part 271 provided at its end with a hole 272 for facilitating the securement of plate 27 to the half-wing 11. Such first part 271 ends at the location at which said pins 285–225 are disposed, where it has a width equal to the distance existing between the pins, when the door is disposed in its close position.

The first part 271, additionally, is contiguous with a second part 273 having diverging sides which form the maximum width portion of plate 27 at a position corresponding to the position of said pins 285–225 when the door is disposed in its opened position.

Figure 13:
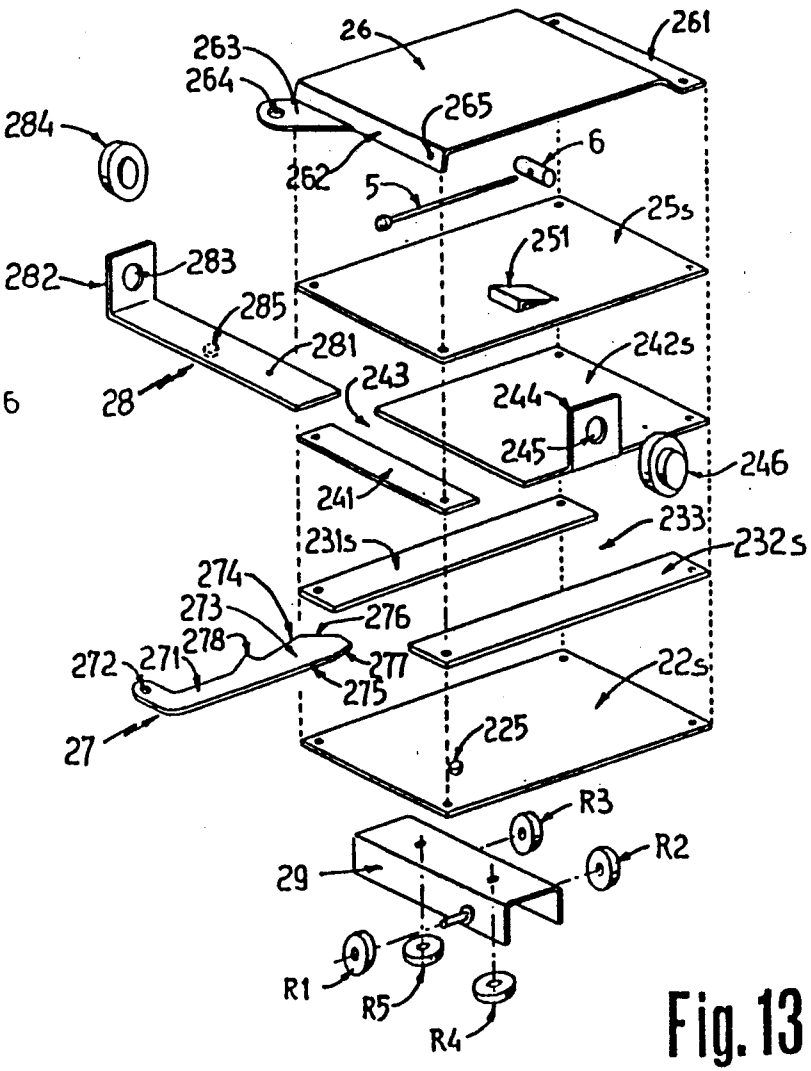
FIGS. 12 and 13 are exploded perspective views of an embodiment of the lower and upper supports of the door, according to the present invention.

As is particularly shown in FIG. 13, the upper truck 20*s* is substantially identical in structure to the above-described lower truck 20*i* and is different therefrom in that it is rather longer and has some different elements.

Therefore, in FIG. 13 the elements which are completely identical to those of FIG. 12 will be marked by the same reference numerals and those differing therefrom in dimensions only will be marked by the literal reference "s" added to the reference numeral. Those elements not included in the truck shown in FIG. 12 (not provided in the lower trucks 20*i*) will be marked by respective reference numerals. Some features that distinguish the trucks from one another include: the lower rectangular plate 22*s* isn't provided with a lug 221 and the upper plate 25*s* is provided with an inclined raised part 251, projecting from the upper part thereof and whose function will be described hereinafter.

Finally, a resilient plate 26 is fitted to the upper part of the truck 20*s*, and a device for allowing adjustment of the elasticity thereof is provided and will be described later.

Said resilient plate 26 is constituted by a rectangular plate of the same size as those of the underlying plates. Plate 26 is bent at its back side so as to form a depressed back edge 261 permitting it to be fixed to the underlying plates and is also folded at its front side so as to form a flange 262 turned downwards, from the left end of which a lug 263 identical to the lug 221 projects towards the front part thereof. Lug 221 is provided with a hole 264 in which the stud 14*s* for connecting the associated half-wing 11 is inserted.

Said lugs 221 and 263 practically form the elements which were previously called, respectively, lower arm 21*i* and upper arm 21*s*.

Moreover, a hole 265 is provided in said flange 262. The hole 262 is aligned with the inclined raised part 251 provided in the underlying plate 25. A screw 5 engages a pin 6, disposed between the resilient plate 26 and the inclined part 251, and extends through the hole 265, thus providing the device for allowing adjustment of the elasticity of the resilient plate 26. As the screw 5 is rotated (refer to FIG. 6), pin 6 is moved up or down inclined part 251 to add tension to a relax resilient plate 26, respectively, so as to bear more or less of the load exerted on arm 21*s* by door 1.

The assembly operates as follows.

Firstly, the accordion door 1 is hung at its upper part to the associated arms 21*s*, while being supported at its lower part on the arms 21*i* and the connection to the latter is effected preferably by means providing a hinged joint. Such an arrangement and the use of the device for allowing adjustment of the elasticity of the resilient plate 26 of the upper trucks 20*s*, permits that part of the weight P of the door loading the upper trucks 20*s* to be adjusted, which fact allows the distribution of the load between these trucks and the lower trucks 20*i* to be optimized, whereby a soft and reliable movement of the accordion door during the opening, closing and translating operation thereof can be realized.

This is all obtained basically by utilizing the above-described trucks 20 which, as already stated, may freely slide along a rectilinear trajectory determined by the guide members 30 without any deviation from such trajectory being effected. The opening of a door occurs in a very simple way when one of its sides is pushed towards the other. FIGS. 1 and 2, to which reference is made hereinafter, clearly illustrate such an operation.

By way of example, in such figures the door shown at the center thereof has been opened by shifting the right-side wing thereof leftwards. In fact, as the right side of the door 1 is pushed to translate leftwards, it is guided by the associated right-side trucks 20*s*–20*i* which are sliding on the correspondent longitudinal guide members 30*s*–30*i* and such trucks 20*s*–20*i* are able to provide, owing to the already specified reasons, a very regular rectilinear movement.

In practice, slight oscillations with respect to the vertical line of the door, which oscillations however are rapidly dampened, may occur but only when improper, very irregular and intense strains are in effect.

While the right side is shifting leftwards, the two half-wings 11 are folded together about the axis defined by the hinge 12, and the central part of the door 1 is shifted outwards.

The movement thereof may be continued until the door is fully opened (see FIG. 2), which operation occurs when the rubber plugs 246 of the right-side trucks 20*s*–20*i* bear against the plugs 246 of the left-side trucks 20*s*–20*i*, which are still since the associated plugs 284 fitted to their movable spacer elements 28 are abutting the correspondent plugs 284 of the left-side trucks 20*s*–20*i* of the door 1 adjacent thereto, which door is still.

The various plugs 246–284 act for deadening the impacts which occur when moving parts are stopped by still parts.

It is noted that, as clearly illustrated in FIG. 2, due to the presence of the trucks 20, the two half-wings 11 of the door 1 remain rather spread apart at the opened position thereof. Such an arrangement is quite advantageous as the vertical stability of the half-wings 11 at this position, as clearly ensured by the trucks 20, is considerably increased owing to the fair amount of separation existing between the two lower trucks 20*i* and the two upper trucks 20*s*.

Obviously, when the door 1 is disposed in its opened position, it may translate freely transversally along the front part of the piece of furniture.

Moreover, it is noted that when a plurality of doors 1 are provided, it is possible to dispose all or at least some of such doors in the opened position, whereby such doors may translate freely transversally along the opening provided at the front of the piece of the furniture.

Finally, with particular reference to FIGS. 8, 9, 10 and 11, the operation of the device for spreading apart the trucks 20 will be described.

FIGS. 8 and 11 show, respectively, the group of trucks 20*i* and 20*s* fitted to the ends of two half-wings 11 of adjacent doors 1 disposed in their closed positions, as also illustrated at the left in FIG. 1. Likewise, FIG. 11 shows the right-side door 1, corresponding to the central door shown in FIGS. 1 and 2, at the open position thereof.

Figure 9:
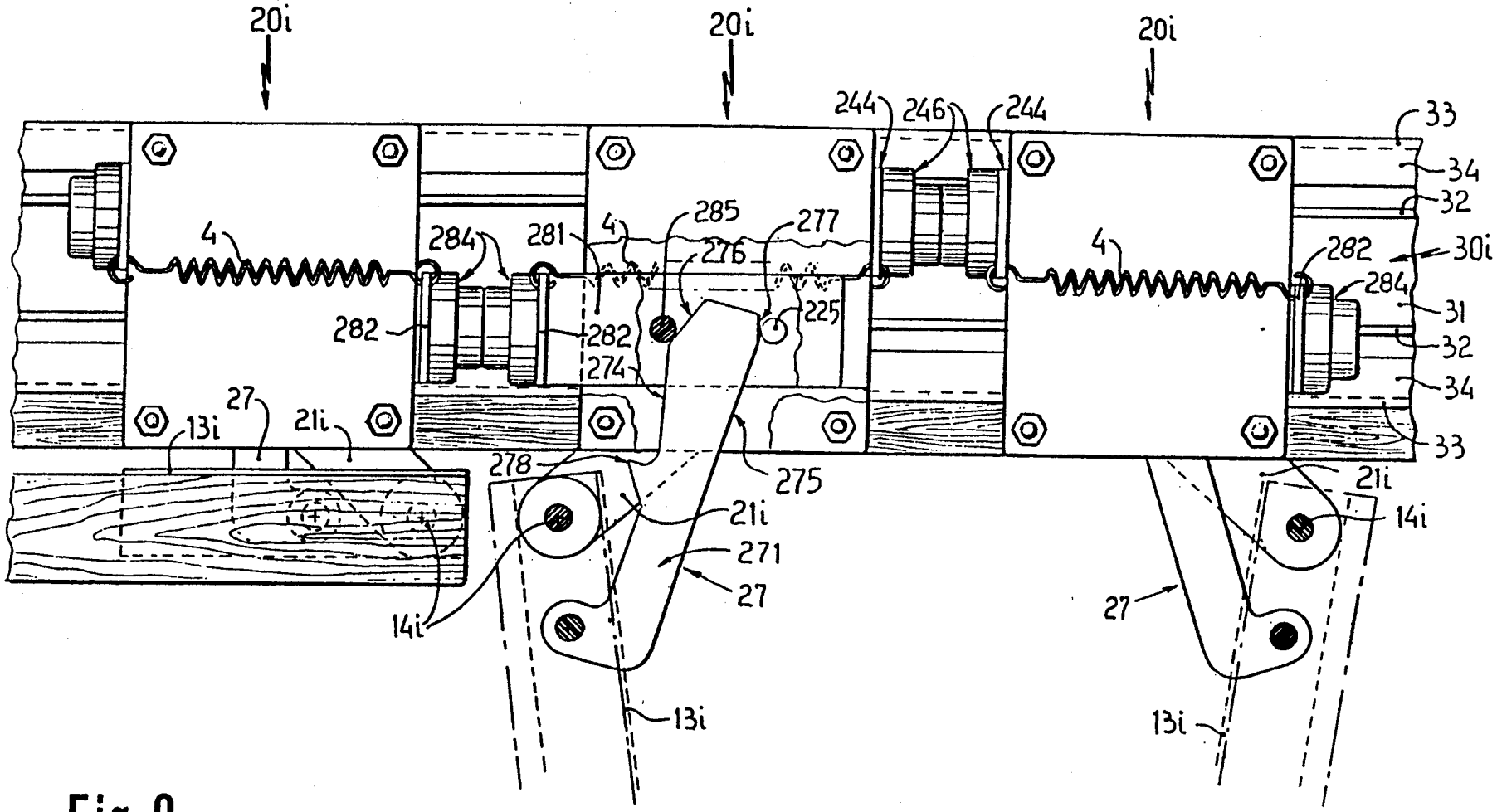
FIG. 9 is a view similar to FIG. 8 showing half-wings of a door in the, open position thereof.

For clarity, reference is made hereinafter to FIGS. 9 and 11 illustrating the upper part of the door, because the action effected at the upper part is likewise effected at the lower part thereof, too.

Therefore, when the door 1 is disposed in its closed position (FIG. 8), both the pin 285*s* connected to the movable spacer element 28*s* and the pin 225*s* connected to the truck 20*s* are positioned at the sides of the first part 271 of the shaped plate 27*s*, adjacent the beginning of the divergent sides 274–275 of the second part 273.

When the door is shifted to its opened position, the half-wing 11 rotates around the stud 14*s*, and therefore also the stud 15*s* connecting the shaped plate 27*s* to the bracket 13*s* fixed to the half-wing 11, thereby causing the shaped plate 27*s* to be pulled outwardly from truck 20*s*.

Consequently, the sides 274 and 275 of said second part 273 of the shaped plate 27*s* which, as already stated, are divergent, slide against the associated pins 285–225 while wedged therebetween, thus moving the correspondent trucks 20*s* away from the respective trucks 20*s* adjacent thereto (which are situated at the left thereof in FIGS. 1, 2, 9 and 11 and remains still).

It follows also that the stud 14*s* of the half-wing 11 and, therefore, the correspondent side edge thereof are progressively moved away from the adjacent door 1 so that the front corner of such side edge which would contact the side edge of the door 1 adjacent thereto if it were not for the above-described device, passes along a trajectory which in fact does not intercept such side edge.

While the half-wing 11 referred to is rotating around the associated studs 14, the other half-wing 11 of the same door 1 rotates around the hinge 12 towards the former. The movement thereof is continued until the trucks 20*s*–20*i* situated at the right part of the door 1 cause, owing to the engagement of the corresponding elastic plugs 246 of the trucks 20*s*–20*i* at the left part of said door 1 with the elastic plugs 246 thereof, the component parts of the unit to be all stopped in the open position thereof clearly illustrated in FIGS. 2 and 9.

As already stated and clearly shown in FIGS. 2 and 9, the left and right trucks 20 thus disposed side by side make it possible for the half-wings 11 to be quite spread apart at the open position thereof, so as to obtain a considerable vertical stability of the door in this position.

When the door 1 is at the open position thereof and said shaped plate 27 is shifted outwardly, the pins contact the convergent parts 276–277 of the plate 27 extending from the respective divergent sides 274–275 thereof.

In this manner, as soon as the portion of plate 27 having the greatest divergency in width has passed pins 285–225, the pins which are biased by the action of the return spring 4 towards one another engage such convergent parts 276–277 so that the half-wings 11 remain locked in position. The door 1 may be closed again by exerting a suitable thrust causing plate 27 to become unlocked by forcing pins 285–225 apart.

Clearly, the return of the door to its closed position occurs exactly in a way opposite to that way in which the door is opened.

The shaped plate 27 has a raised tooth 278 at the same side thereof as the divergent side 274, which tooth bears against the pin 285 when the associated door is disposed in its closed position, thus ensuring the correct positioning of the two half-wings 11 in the desired coplanar state. Moreover, instead of the two divergent sides 274–275 of said second part 273 being rectilinear, they may be curvilinear having an initial part with a high divergency curving into two subsequent parts with limited divergency so that the corner of the side edge of the door is moved away from the adjacent edge just at the beginning of the opening movement of the door 1. Such a trajectory is considered to be more safe and to completely space apart the adjacent edges of the doors.

Still referring to FIGS. 1, 2 and 9, at the end of the closing movement of the door, the plugs 284 of the right-side trucks 20*s*–20*i* bear against the corresponding elastic plugs 284 of the trucks 20*s*–20*i* of the left part of the door 1 adjacent thereto, whereby the door 1 is stopped and positioned between two laterally adjacent doors 1.

The function of the various elastic plugs 246, 284 is to deaden the blows upon impact and hence, stop the respective parts which are being moved against corresponding still parts.

It is clear that the door 1 disposed in the open position thereof, as illustrated by the FIG. 2, may freely translate laterally along the front of the piece of furniture.

Obviously, also a group of doors 1 all disposed in the open position may freely translate in a likewise manner. Finally, also the doors disposed in their closed position may translate laterally when the adjacent doors are disposed away therefrom.

It is also to be noted that the accordion doors may be formed by three panels instead of by two panels constituting the two half-wings 11. This further possible embodiment is indicated by wa of example with a dashed line in FIG. 2. In this case, the third panel marked with the reference numeral 11*a* is supported, at the ends of the vertically extending side thereof which is adjacent to the side of an adjacent door, on trucks 20*a* identical to the already described trucks and whose movable spacer elements 28*a* abut the movable spacer elements 28*s* (28*i*) of the half-wing 11 adjacent thereto or form a single element with the same.

As clearly illustrated in FIG. 2, in order for the third panel 11*a* to be disposed at least orthogonally to the piece of furniture, when the thus formed door is opened, the shaped plates 27*a* of the associated trucks 20*a* must be relatively long. And, more precisely, the divergent sides of the second part thereof will also have to be adequately long.

From this detailed description, the particular structural and operative features as well as the utility of the accordion door are clear, together with the advantages facilitated thereby with respect to the manufacturing and assembling thereof.

It will be understood that different variants of the various elements and devices of the door referred to herein may be adopted without departing from what is claimed, and therefore all such variants are seen to be within the true spirit and scope of the present invention.

What is claimed is:

1. Accordion door structure of a piece of furniture, or the like, having a frame, said structure comprising:

upper and lower guide members extending longitudinally and fixed at upper and lower parts of the frame, respectively;

an accordion door including at least two wings having respective first vertically extending sides which confront one another and respective second vertically extending sides opposite thereto, and hinge means for hinging said wings to one another along a hinge axis extending vertically along said first sides thereof in a manner which allows said wings to be rotated relative to one another about said axis;

support elements slidably mounted to said upper and said lower guide members, respectively;

each of said support elements being a truck having a set of wheels rotatably supported thereon and an arm projecting therefrom so as to form a cantilever, two of the wheels in said set spaced along a y-axis extending transversely of said guide members and having axes of rotation parallel to said y-axis, two of the wheels in said set spaced from one another along an x-axis extending longitudinally of said guide members and orthogonal to said y-axis and having axes of rotation parallel to said y-axis, and two of the wheels in said set being spaced apart along said x-axis and having axes of rotation parallel to a z-axis orthogonal to both said x and said y axes;

said wings of the accordion door being pivotally connected, at upper and lower ends of each of said second vertically extending sides thereof, to a said arm of a respective one of said support elements so as to be support in the piece of furniture, or the like, in a cantilever manner by said support elements;

said support elements being slidable along said guide members so as to enable said accordion door to be moved between a closed position at which said wings thereof are coplanar, and an open position at which said wings are folded about said hinge axis and said second vertically extending sides are located close to one another;

each of said support elements having spreading means, operatively connected to the respective one of said wings that is pivotally connected to the arm thereof, for causing the second vertically extending side of the respective one of said wings to translate in a direction along said guide members toward the first vertically extending side of said respective one of said wings when said respective one of said wings is pivoted about the arm of the support element to which it is pivotally connected, whereby when said accordion door is moved from said open position to said closed position thereof by sliding first ones of said support elements pivotally connected to one of said wings along said guide members toward second ones of said support elements pivotally connected to the other of said wings, said wings rotate relative to one another about said hinge axis and said other of said wings pivots about the arms of each of said support elements to which it is pivotally connected thereby causing the spreading means of said support elements pivotally connected to said other of said wings to move the second vertically extending side thereof away from any structure adjacent thereto in said closed position; and each of said support elements having a spacer fixed relative thereto, the fixed spacers of the support elements which are pivotally connected to one of said wings at the upper and lower ends of the second vertically extending side thereof being respectively aligned, in the longitudinal direction of said guide members, with the fixed spacers of the support elements which are pivotally connected to the other of said wings, the aligned spacers abutting one another when the accordion door is in said open position thereof so as to maintain said wings spread apart to a predetermined extent while said wings are folded about said hinge axis.

2. Accordion door structure as claimed in claim 1, wherein said accordion door rests atop the arm of each of the support elements slidably mounted to said lower guide member, and is hung from the arm of each of the support elements slidably mounted to said upper guide member, and each of said support elements slidably mounted to said upper guide member comprises a resilient plate from which the arm thereof extends, and load adjusting means cooperating with said resilient plate for allowing the distribution of the load exerted by the door between the support elements slidingly mounted to said upper guide member and the support elements slidingly mounted to said lower guide member to be adjusted.

3. Accordion door structure as claimed in claim 2, wherein said spreading means includes a first pin projecting in and fixed relative to said support element, a movable spacer element slidingly supported in the support element and from which a second pin extends, said movable spacer element having an end thereof disposed at an outer side of said support element and a rubber plug fitted to said end thereof, and a shaped plate pivotally connected at one end to the wing of said accordion door adjacent the pivotal connection thereof to the support element, said shaped plate including a portion thereof having sides diverging from said end thereof, said portion being wedged between said pins as said accordion door is moved from said closed position to said open position thereof to force said movable spacer element out of the support element at the outer side thereof.

4. Accordion door structure as claimed in claim 3, wherein said spreading means further includes guide structure guiding said movable spacer element in said support element along a path of reciprocating movement in which said first and said second pins are moved toward and away from one another, and spring means engaging said movable spacer element for biasing said second pin thereof toward said first pin.

5. Accordion door structure as claimed in claim 3, wherein the fixed spacer of each respective said support element includes a lug and a rubber plug fitted to the lug opposite the rubber plug of the movable spacer element of the respective support element.

6. Accordion door structure of a piece of furniture, or the like, having a frame, said structure comprising:

upper and lower guide members extending longitudinally and fixed at upper and lower parts of the frame, respectively;

an accordion door including at least two wings having respective first vertically extending sides which confront one another and respective second vertically extending sides opposite thereto, and hinge means for hinging said wings to one another along a hinge axis extending vertically along said first sides thereof in a manner which allows said wings to be rotated relative to one another about said axis;

support elements slidably mounted to said upper and said lower guide members, respectively;

each of said support elements having an arm projecting therefrom so as to form a cantilever;

said wings of the accordion door being pivotally connected, at upper and lower ends of each of said second vertically extending sides thereof, to a said arm of a respective one of said support elements so as to be support in the piece of furniture, or the like, in a cantilever manner by said support elements with said accordion door resting atop the arm of each of the support elements slidably mounted to said lower guide member and being hung from the arm of each of the support elements slidably mounted to said upper guide member;

said support elements being slidable along said guide members so as to enable said accordion door to be moved between a closed position at which said wings thereof are coplanar, and an open position at which said wings are folded about said hinge axis and said second vertically extending sides are located close to one another;

each of said support elements slidably mounted to said upper guide member comprising a resilient plate from which the arm thereof extends, and load adjusting means cooperating with said resilient plate for allowing the distribution of the load exerted by the door between the support elements slidingly mounted to said upper guide member and the support elements slidingly mounted to said lower guide member to be adjusted;

each of said support elements having spreading means, operatively connected to the respective one of said wings that is pivotally connected to the arm thereof, for causing the second vertically extending side of the respective one of said wings to translate in a direction along said guide members toward the first vertically extending side of said respective one of said wings when said respective one of said wings is pivoted about the arm of the support element to which it is pivotally connected, whereby when said accordion door is moved from said open position to said closed position thereof by sliding first ones of said support elements pivotally connected to one of said wings along said guide members toward second ones of said support elements pivotally connected to the other of said wings, said wings rotate relative to one another about said hinge axis and said other of said wings pivots about the arms of each of said support elements to which it is pivotally connected thereby causing the spreading means of said support elements pivotally connected to said other of said wings to move the second vertically extending side thereof away from any structure adjacent thereto in said closed position; and each of said support elements having a spacer fixed relative thereto, the fixed spacers of the support elements which are pivotally connected to one of said wings at the upper and lower ends of the second vertically extending side thereof being respectively aligned, in the longitudinal direction of said guide members, with the fixed spacers of the support elements which are pivotally connected to the other of said wings, the aligned spacers abutting one another when the accordion door is in said open position thereof so as to maintain said wings spread apart to a predetermined extent while said wings are folded about said hinge axis.

7. Accordion door structure of a piece of furniture, or the like, having a frame, said structure comprising:

upper and lower guide members extending longitudinally and fixed at upper and lower parts of the frame, respectively;

an accordion door including at least two wings having respective first vertically extending sides which confront one another and respective second vertically extending sides opposite thereto, and hinge means for hinging said wings to one another along a hinge axis extending vertically along said first sides thereof in a manner which allows said wings to be rotated relative to one another about said axis;

support elements slidably mounted to said upper and said lower guide members, respectively;

each of said support elements having an arm projecting therefrom so as to form a cantilever;

said wings of the accordion door being pivotally connected, at upper and lower ends of each of said second vertically extending sides thereof, to a said arm of a respective one of said support elements so as to be support in the piece of furniture, or the like, in a cantilever manner by said support elements;

said support elements being slidable along said guide members so as to enable said accordion door to be moved between a closed position at which said wings thereof are coplanar, and an open position at which said wings are folded about said hinge axis and said second vertically extending sides are located close to one another;

each of said support elements having spreading means, operatively connected to the respective one of said wings that is pivotally connected to the arm thereof, for causing the second vertically extending side of the respective one of said wings to translate in a direction along said guide members toward the first vertically extending side of said respective one of said wings when said respective one of said wings is pivoted about the arm of the support element to which it is pivotally connected, said spreading means including a first pin projecting in and fixed relative to said support element, a movable spacer element slidingly supported in the support element and from which a second pin extends, said movable spacer element having an end thereof disposed at an outer side of said support element and a rubber plug fitted to said end thereof, and a shaped plate pivotally connected at one end to the wing of said accordion door adjacent the pivotal connection thereof to the support element, said shaped plate including a portion thereof having sides diverging from said end thereof, said portion being wedged between said pins as said accordion door is moved from said closed position to said open position thereof to force said movable spacer element out of the support element at the other side thereof, whereby when said accordion door is moved from said open position to said closed position thereof by sliding first ones of said support elements pivotally connected to one of said wings along said guide members toward second ones of said support elements pivotally connected to the other of said wings, said wings rotate relative to one another about said hinge axis and said other of said wings pivots about the arms of each of said support elements to which it is pivotally connected thereby causing the spreading means of said support elements pivotally connected to said other of said wings to move the second vertically extending side thereof away from any structure adjacent thereto in said closed position; and each of said support elements having a spacer fixed relative thereto;

the fixed spacers of the support elements which are pivotally connected to one of said wings at the upper and lower ends of the second vertically extending side thereof being respectively aligned, in the longitudinal direction of said guide members, with the fixed spacers of the support elements which are pivotally connected to the other of said wings, the aligned spacers abutting one another when the accordion door is in said open position thereof so as to maintain said wings spread apart to a predetermined extent while said wings are folded about said hinge axis.

8. Accordion door structure as claimed in claim 7, wherein said spreading means further includes guide structure guiding said movable spacer element in said support element along a path of reciprocating movement in which said first and said second pins are moved toward and away from one another, and spring means engaging said movable spacer element for biasing said second pin thereof toward said first pin.

9. Accordion door structure as claimed in claim 7, wherein the fixed spacer of each respective said support element includes a lug and a rubber plug fitted to the lug opposite the rubber plug of the movable spacer element of the respective support element.

* * * * *